US005431368A

United States Patent [19]

Wilde

[11] Patent Number: 5,431,368

[45] Date of Patent: Jul. 11, 1995

[54] TIE FOR CONCRETE WALL FORMS

[76] Inventor: Richard L. Wilde, 2440 E. 6175 South, Ogden, Utah 84403

[21] Appl. No.: 220,609

[22] Filed: Mar. 31, 1994

[51] Int. Cl.[6] ..... E04G 17/06

[52] U.S. Cl. ..... 249/213; 249/40; 249/91

[58] Field of Search ..... 249/40, 91, 213, 218; 52/699, 712

[56] References Cited

U.S. PATENT DOCUMENTS

| | | | |
|---|---|---|---|
| 1,237,999 | 8/1917 | Burnett | 249/91 |
| 1,564,888 | 12/1925 | Orlopp et al. | 249/218 |
| 1,575,931 | 3/1926 | Orlopp | 249/218 |
| 1,784,329 | 12/1930 | Bierhaalder | 249/213 |
| 1,924,724 | 8/1933 | Olney | 52/699 |
| 2,099,260 | 11/1937 | Colt | 249/213 |
| 3,197,171 | 7/1965 | Michalak | 249/91 |
| 3,469,815 | 9/1969 | Brenneman | 249/218 |
| 3,530,634 | 9/1970 | Adams | 249/91 |
| 4,247,073 | 1/1981 | Vario | 249/40 |
| 4,936,540 | 6/1990 | Boeshart | 249/218 |

FOREIGN PATENT DOCUMENTS

| | | | |
|---|---|---|---|
| 659873 | 3/1963 | Canada | 249/218 |

*Primary Examiner*—James P. Mackey
*Attorney, Agent, or Firm*—A. Ray Osburn

[57] ABSTRACT

A tie for concrete wall form assemblies, adapted to secure individual wall forms together, and to secure horizontal reinforcing members against both horizontal and vertical displacement. Upwardly opening notches accept and position the reinforcing members. The notches are sized and shaped to permit inversion of alternate ties along the form structure, to restrain reinforcement movement downwardly, upwardly and laterally.

8 Claims, 5 Drawing Sheets

TIE FOR CONCRETE WALL FORMS

BACKGROUND OF THE INVENTION

1. Field

The present invention relates to ties for poured concrete wall forming systems, and more particularly to such ties that provide for retention of reinforcing bars within the forms.

2. State of the Art

Wall forming systems have been in use for many years and in many embodiments. However, most of the systems require a means of support of a pair of spaced apart vertical frames to which a pair of form panels are attached. The frames may be of temporary construction of wood, or even plastic, but are generally of steel and designed for repeated re-use. Whatever the specific construction of the panel framing, cross ties from one to the other are required, to maintain the form frames and panels in true upright position, parallel to each other, and spaced apart the proper distance. The form ties are typically provided in both horizontal and vertical spaced apart relationship, serving to both prevent spreading of the forms and local bowing of the forms under the hydrostatic pressure from the uncured essentially liquid concrete. After cure, frames and panels are removed, leaving the ties within the cured concrete. Protruding ends of the ties are generally removed flush with the concrete, usually by breaking at notches provided for this purpose.

The form ties are also used to support horizontal reinforcing bars during pouring of the concrete. Typically, the reinforcing bars are secured to the form ties by manually twisted wire loops. Overlapping reinforcing bars are similarly secured together. This procedure is always time consuming, and does not promote accuracy in reinforcing bar placement. Fastening of each bar to each tie is generally required, but negligent omissions are common. The bars are often not fastened firmly, are free to slide sidewise along the smooth ties. Because of such shortcomings, several form tie designs have been proposed with specific provisions for securing the reinforcing members. Examples include U.S. Pat. Nos. 3,197,171, 1,784,329 and 3,530,634. The first of these discloses preformed wire clips welded or brazed to a steel form tie to secure the reinforcing bars. The second discloses a reinforcing bar securing clip arrangement punched and sheared from a plate member which is shaped to be used as a form tie. The last discloses a separate, plastic molded spacer and holder for the reinforcing bars. This holder spans across and butts against the opposing form panels. These disclosed solutions to the reinforcing bar placement problem are relatively simple compared to other proposed solutions. U.S. Pat. No. 4,936,540 discloses a form tie in strap form which includes an upwardly opening notch for a single reinforcing member, representing a partial solution to the problem. However it does not address the problem of overlapping reinforcing members, nor of vertical dislodgement of the bars during pouring. All of the devices that are apparently available involve additional expense and provide only partial solutions.

Clearly, an improved form tie construction is needed that is not prohibitively costly and facilitates reliable reinforcing member placement.

BRIEF DESCRIPTION OF THE INVENTION

With the foregoing in mind, the present invention eliminates or substantially alleviates the shortcomings in previous concrete form ties. The inventive tie is in the form of a strap, preferably of steel, and incorporates means for attachment of its ends to form panel assemblies for wall construction. Each tie has at least one notch longitudinally positioned to accept at least one reinforcing member. Each notch is shaped and sized so that the ties may be successively installed in the forms alternately inverted, so as to be alternately over and under the reinforcing members. In this manner, the reinforcing members are restrained against horizontal shifting and also against vertical displacement. Preferably, the notches are sufficiently wide to accept a pair of overlapping bars side by side, eliminating any need to secure the bars together with manual wire loops to prevent sagging or separation of the end portions.

So that the straps may be inverted as described above without interference with the reinforcing members, each notch is constructed to be of a depth into the strap equal to one half the width of the strap plus the radius of the reinforcing member. Each notch is preferably accompanied by an opposing protrusion from the opposite side of the strap which is shaped and sized identically to the notch. With this configuration, strap ties may be successively sheared from thin plate material with essentially no material loss. The notches,in this embodiment of the invention, are of trapezoidal or trapezoid-like shape, the sides of each notch diverging outwardly and upwardly at an angle selected to provide sufficient material for dimensional stability of the strap in the notch area.

Notches are provided as required along the ties for placement of the reinforcing members, centrally or offset from center, or both. According to one aspect of the invention, each tie may have a pair of spaced apart notches opening from one side of the strap, and also another, centrally located notch opening to the opposite side of the strap. With this configuration, the ties may, as needed, be installed to accommodate spaced apart reinforcing members or inverted for a single, centrally located member.

The principal object of the invention is therefore to provide an economically constructed, improved strap tie for concrete wall forming, eliminating or minimizing manual tying of the reinforcing members, while reliably restraining the reinforcing member from being horizontally or vertically displaced during concrete pour.

BRIEF DESCRIPTION OF THE DRAWINGS

In the drawings, which represent the best modes currently contemplated for carrying out the invention.

DETAILED DESCRIPTION OF ILLUSTRATED EMBODIMENTS

Figure 1:
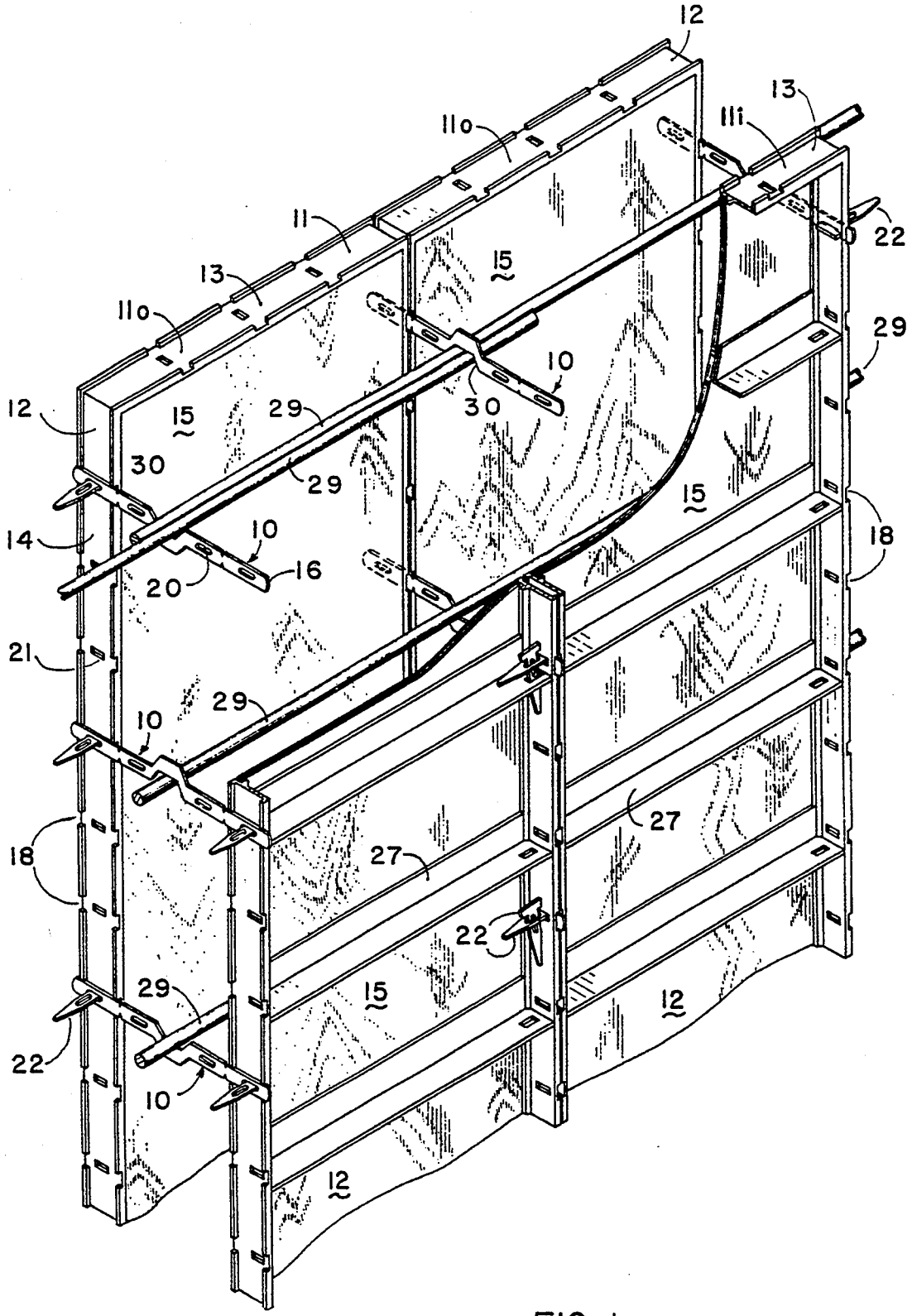
FIG. 1 is a perspective view of a fragment of a concrete wall form assembly, cut away to show strap ties in accordance with the invention in place connecting opposing sides of the form structure together and securing horizontal reinforcing members, drawn to a reduced scale, FIG. 2 an upper right perspective view of the strap tie in accordance with the invention, having a pair of reinforcing bar locating notches, drawn to approximately full scale, FIG. 3 a perspective view of a fragment of the form structure of FIG. 1, showing a form strap in accordance with the invention in place for securement to a frame of the form structure, drawn to approximately full scale, FIG. 4 a perspective view of a wedge bolt used to secure the strap ties to the form frame members, drawn to approximately full scale, FIG. 5 a perspective view of a series of strap ties in accordance with the invention, shown separated from the framing structure and alternately inverted to restrain reinforcing members against vertical displacement, drawn to substantially full scale, FIG. 6 a view of a fragment of the strap tie assembly of FIG. 5, showing geometrical requirements of the notches of said strap ties permitting the alternate inversion thereof, drawn to approximately full scale, FIG. 7 a plan view of a portion of a thin plate, showing the pattern of form ties to be sheared therefrom, drawn to approximately full scale, FIG. 8 a side elevation view of a prior art strap tie, drawn to a reduced scale, FIG. 9 a plan view of a portion of a thin plate, showing the pattern of form ties of another embodiment to be sheared therefrom, drawn to approximately full scale, and FIG. 10 a side elevation view of an embodiment of a strap tie in accordance with the invention having a pair of spaced apart notches opening in one direction and a single central notch opening in the opposite direction.
Figure 8:
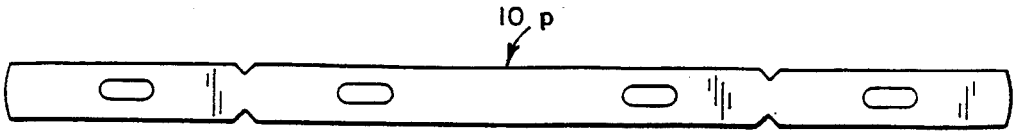
FIG. 8 PRIOR ART

Referring now to the drawings, in which similar or corresponding parts are designated with the same reference number throughout, the form tie of the present invention is designated generally as 10, and comprises a shaped elongate strap, preferably of steel. In FIG. 1 strap ties 10 are illustrated as incorporated into a fragment of an assembled concrete wall form in readiness to be poured full of uncured concrete. Wall form assembly 11 comprises individual sections 12 joined into a pair of spaced apart opposing form structures 11*i* and 11*o*. Each section 12 has a metal frame therearound, comprising horizontal portions 13 and vertical portions 14, the latter at an end of each section 12. The frame is configured to accept form panel 15, of plywood, for example. The panels 15 are held spaced apart by the strap ties 10, which are in the illustrated embodiment generally interchangeable with a common strap tie embodiment 10*p*. (FIG. 8)

Each strap tie 10 has a pair of portions 16 of equal vertical height, aligned about a horizontal axis 17, the height being selected so that these end portions will fit within vertical frame notches 18 provided in outstanding flanges 19 of vertical frame portions 14.

Strap tie 10 carries a series of elongate slots 20 spaced along its length. Identically dimensioned horizontal elongate slots 21 are carried by the end framing members 14. The tie and form slots are aligned, and the straps secured to the frames by forcibly driven wedge bolts 22, which comprise tapering portions 23 joined by untapered portions 24 in turn joined by a broad headpiece 25. Each wedge bolt 22 also carries a longitudinally aligned elongate slot 26 of the same dimensions as the strap and frame slots. Pairs of wedge bolts 22 may be used to secure straps 10 between a pair of vertical frames 14 to connect form sections 12. (FIG. 1)

The thickness of the concrete wall is determined by straps 10 holding opposing form structures 11*i* and 11*o* spaced the proper distance apart. Each strap tie 10 has a pair of opposing stress concentrating "V" notches 28 at the inside surfaces of the form assemblies. (FIGS. 2 & 3) Differing wall thicknesses are achieved by selecting ties 10 with corresponding distances between the notches 28. The ties 10 are vertically spaced by selective use of frame notches 18. Angle members 27 stiffen and support form panels 15. After concrete cure, the form assemblies are removed by extraction of wedge bolts 22, leaving strap end portions 16 protruding, to be broken away at the "V" notches flush with the cured concrete by hammer blows.

Concrete wall structures typically contain horizontal steel reinforcing bars 29. The reinforcing members 29 are placed to prevent cracking of the concrete from cure shrinkage or temperature changes, or to provide bending strength to the wall structure. For shrinkage cracking, reinforcing members 29 may be placed at the vertical centerline plane of the wall. For bending, horizontally spaced apart bars are needed. The bars 29 should be placed with accuracy, and held in place during pouring of the thick uncured concrete. Each strap tie 10 incorporates cradle notches 30 to locate and restrain the reinforcing members 29, and are preferably sized for side by side pairs. (FIGS. 1–3,5) Cradles may be provided centrally in the wall, and/or offset in either or both directions from center, as required by the wall design.

Figure 5:
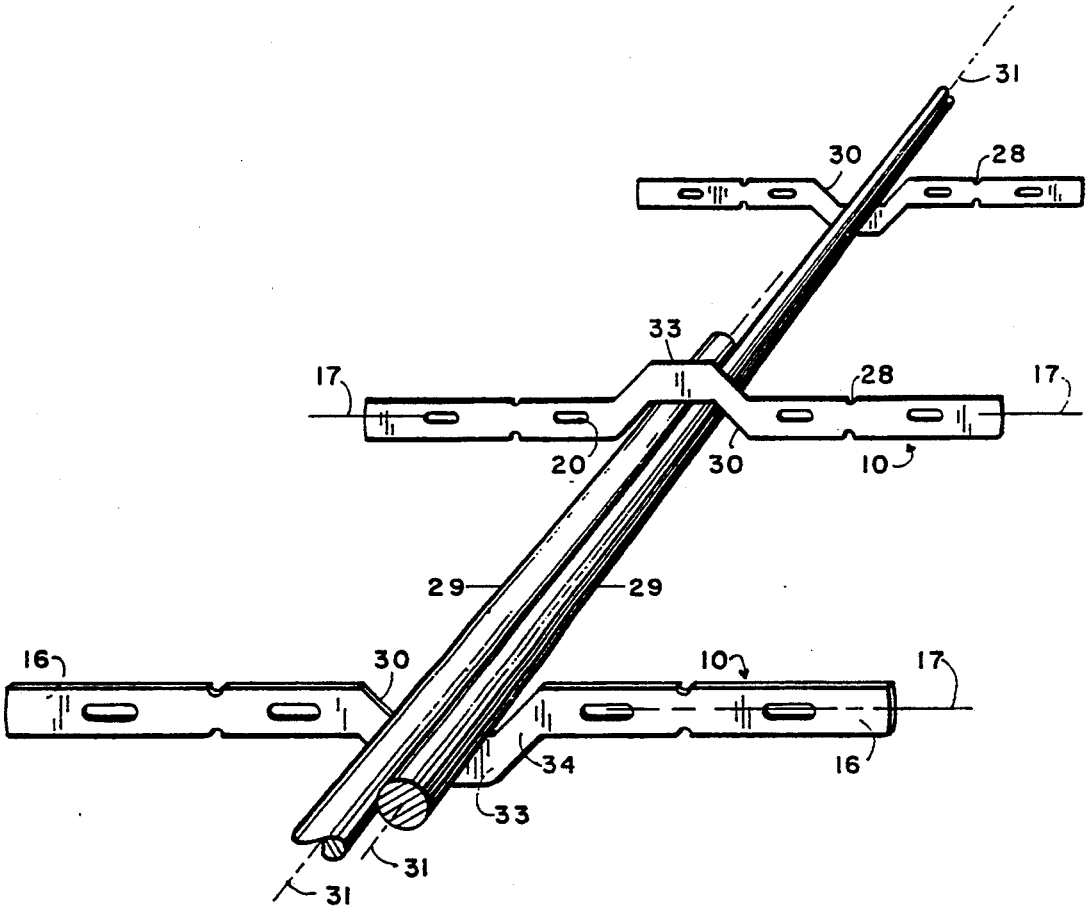
Figure 6:
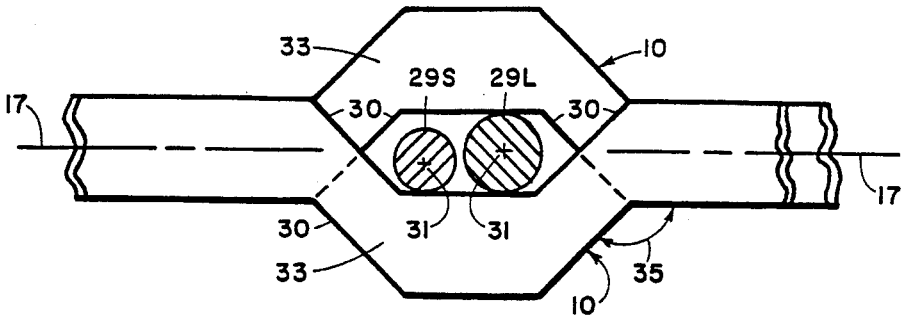

The density of the uncured concrete is not sufficient to float steel reinforcing members 29, but upward forces on the bars during rapid pouring must be resisted. Both horizontal and vertical restraint is therefore needed, and is provided by alternately inverted straps 10. (FIGS. 1, 5 & 6)

Figure 2:
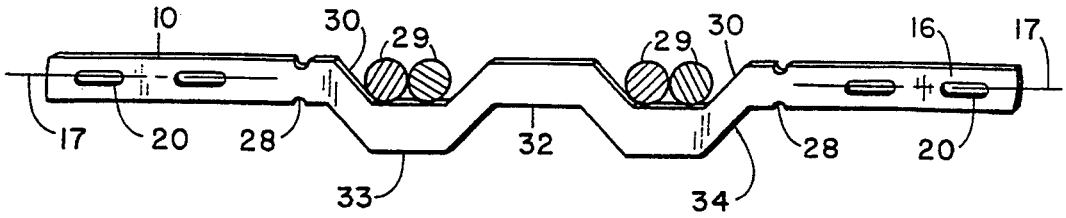
Figure 3:
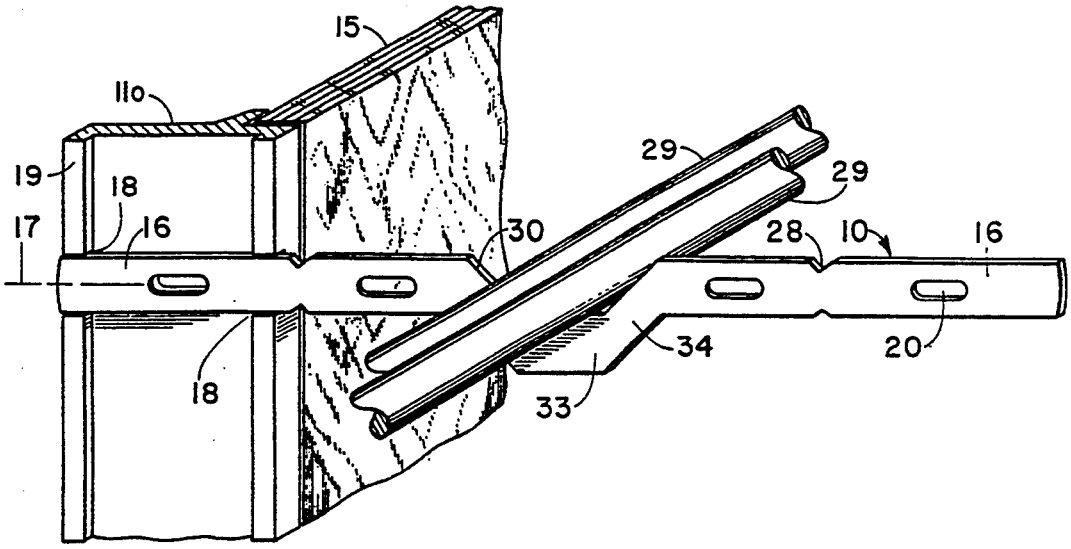
Figure 4:
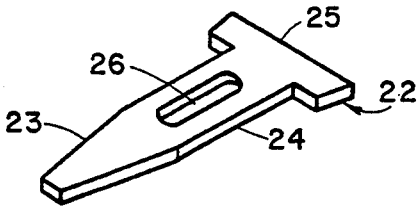

To invert the strap 10, it is secured rotated about the common centerline 17 of the end portions 16. The cradle notches 30 are preferably at least deep enough for the bar 29 to rest with its axis 31 at the level of strap axis 17, to avoid interference with the inverted cradles. (FIG. 5) In practice, cradle 30 may be constructed deeply enough to generously accommodate the largest bar 29L expected to be used, since only differences of only small fractions of an inch are involved, smaller than customary framing tolerances. Smaller bars 29S are quite free to move vertically, but only within acceptable limits. Both large and small bars may be shifted horizontally a considerable, but acceptable, amount, the cradle 30 being widened to accommodate overlapping ends of the bars 29. (FIG. 2)

Tie sections 32 between the cradles 30 are of equal depth to, and in line with, end portions 16. The shapes of the protrusions 34 are congruent to the shapes of the cradle notches 30. Consequently, successive straps 10 may be sheared from a plate of suitable thickness with virtually no material waste. For safety in handling, the edges of the sheared straps are preferably deburred, either utilizing an acid bath or mechanical means.

Figure 7:
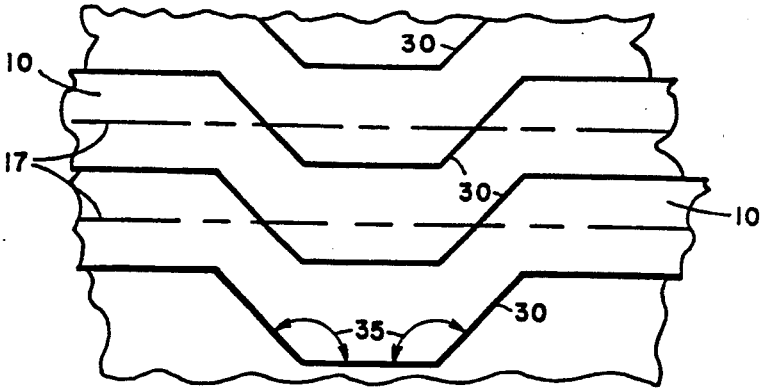

The cradle notches 30 are necessarily trapezoidal, or trapezoid-like in shape, to provide substantial width to strap portion 35, for strength and/or dimensional stability. Illustrated forming angles 35 of approximately 135 deg. have proven satisfactory, even for notch depths equal to or greater than the full height of the strap portions 33 and 16. (FIGS. 6 & 7) Somewhat smaller angles could probably be used, even for such depths, if desired. Shallower notches could be accommodated with considerably smaller obtuse angles 35.

Figure 9:
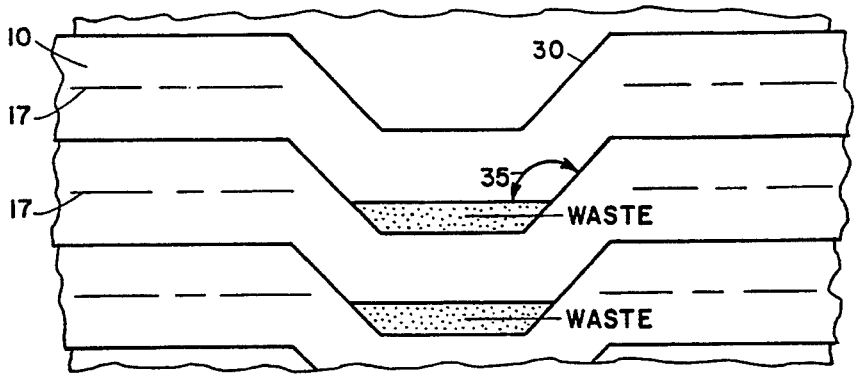

The strap tie 10 could, with attendant increase in waste material, incorporate protrusions 33 not identical in shape to the cradle notches 30, while remaining invertible by rotation about the strap axis 17. (FIG. 9)

This is not preferred because of the increase in waste, the additional shearing steps, the danger of weakening the tie unduly at the notches 30, and attendant restriction of the ties for use only with smaller reinforcing members 29.

Figure 10:
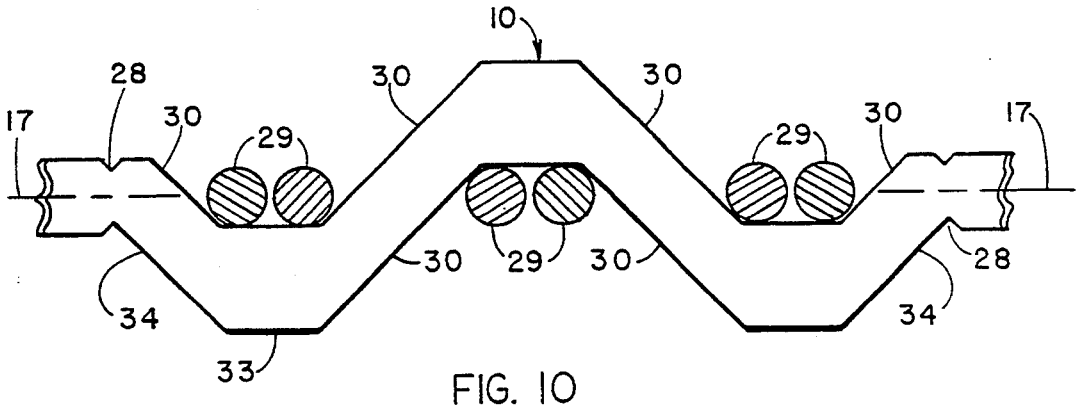

If desired, strap tie 10 could be configured as shown in FIG. 10, with a pair of spaced apart notches 30 opening at one edge and a central notch 30 opening at the other edge of tie 10. This tie configuration may be used as needed for spaced apart reinforcing members 29 in one form structure, or, in another structure, for a single, centrally located, reinforcing member 29. For ties 10 of sufficient length, notches 30 may conceivably be provided suitable for use with still other reinforcing member arrangements.

The illustrated form tie 10 is adapted for connection to the common wall form assemblies 11, but may in practice be adapted for use with other types of form wall structures, not illustrated, which may include, among others, structures using plastic form sheets.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patents is:

1. A form tie for securing a pair of concrete wall form structures together in vertically upstanding, spaced apart relationship, said tie comprising:

an elongate strap of constant thickness, having a pair of opposed upper and lower edges and being of sufficient length to span horizontally between the spaced apart form structures, said strap having a pair of longitudinally aligned opposing end portions having a common longitudinal axis, each said end portion carrying means for securing said end portion to one of the pair of form structures;

at least one notch opening at one of the edges of the strap, said notch being sized to accept at least one elongate reinforcing member having an axis directed perpendicularly to the vertical plane of the strap, the depth of the notch into the strap being sufficient to permit installation of a series of the ties horizontally spaced apart with the longitudinal axes thereof at a common elevation, with the notches of successive ties alternately opening upwardly and downwardly about the elongate reinforcing member; further comprising a strengthening protrusion of the strap opposite to the notch.

2. The form tie of claim 1, wherein:

the protrusion of the strap oppositely from the notch is identically shaped and sized to said notch.

3. The form tie of claim 2, further comprising:

a strengthening protrusion of the strap opposite to the notch.

4. The form tie of claim 3, wherein:

the protrusion of the strap oppositely from the notch is identically shaped and sized to said notch.

5. The tie of claim 4, wherein:

the notch has sides diverging in a direction outwardly of the strap.

6. The tie of claim 1, wherein:

the depth of the notch into the strap is at least sufficient for the reinforcing member to rest upon the bottom thereof with its axis generally at the same elevation as the common longitudinal axis of the strap.

7. The tie of claim 4, wherein:

the depth of the notch into the strap is at least sufficient for the reinforcing member to rest upon the bottom thereof with its axis generally at the same elevation as that of the common longitudinal axis of the strap.

8. The form tie of claim 1, further comprising:

at least one additional notch, said additional notch opening at the other of the edges of the strap, said additional notch being sized to accept at least one elongate reinforcing member having an axis directed perpendicularly to the vertical plane of the strap, the depth of the additional notch into the strap being sufficient to permit installation of a series of ties with said additional notch horizontally spaced apart with the longitudinal axes thereof at a common elevation, with the additional notches of successive ties alternately opening upwardly and downwardly about the elongate reinforcing member; wherein said tie includes two notches spaced apart and each opening to the same edge of the strap; and said additional notch opening to the other edge of the strap at a longitudinal location upon the strap intermediate to the two spaced apart notches.

* * * * *